US005642831A

United States Patent [19]

Lynd

[11] Patent Number: 5,642,831

[45] Date of Patent: Jul. 1, 1997

[54] BEVERAGE CONTAINER WITH VERTICALLY ADJUSTABLE BASE

[75] Inventor: L. Grant Lynd, Canal Winchester, Ohio

[73] Assignee: National Packaging Corporation, Columbus, Ohio

[21] Appl. No.: 546,565

[22] Filed: Oct. 20, 1995

[51] Int. Cl.[6] ..... B65D 8/06; B65D 25/24

[52] U.S. Cl. ..... 220/8; 220/4.03; 220/435; 220/469; 220/629; 220/710.5

[58] Field of Search ..... 220/8, 568, 4.03, 220/435, 530, 534, 541, 546, 629, 720, 737, 740, 710.5, 469, 711, 630; 224/282, 483, 556, 926

[56] References Cited

U.S. PATENT DOCUMENTS

| | | | |
|---|---|---|---|
| 750,632 | 1/1904 | Fisher | 220/8 X |
| 1,296,742 | 3/1919 | Bevington | 220/8 |
| 4,784,112 | 11/1988 | Hayashi | 220/8 X |
| 4,928,848 | 5/1990 | Ballway | 220/737 X |
| 5,044,515 | 9/1991 | Straub | 220/630 |
| 5,531,353 | 7/1996 | Ward et al. | 220/630 X |

*Primary Examiner*—Allan N. Shoap
*Assistant Examiner*—Niki M. Kopsidas
*Attorney, Agent, or Firm*—Thomas S. Baker, Jr.

[57] ABSTRACT

A drinking container is provided having a liquid containing portion and a slidably displaceable sleeve member. The slidably displaceable sleeve member is located adjacent the liquid containing portion. The liquid containing portion has a bottom surface. The sleeve member has a sidewall and a bottom surface. The sleeve member in a first position has its bottom surface spaced apart from the bottom surface of the liquid containing portion a first distance, while the sleeve member in a second position has its bottom surface spaced apart from the bottom surface of the liquid containing portion a second distance. The drinking container preferably has an upwardly projecting wall having at least one engaging member. Additionally, the sleeve member has a plurality of channels formed in its sidewall. The drinking container is formed having a first wall member and a second wall member, such that the sleeve member is retained between the first and second wall members. The liquid containing portion of the drinking container is configured to hold a maximum predetermined volume of liquid, which volume does not change when the sleeve member is displaced from its first position to its second position. The plurality of channels associated with the sleeve member include a first vertical channel, a second vertical channel, an intermediate horizontal channel connecting the two, and a plurality of horizontal retention channels, each of the horizontal retention channels being connected to the second vertical channel.

15 Claims, 7 Drawing Sheets

2
72
74
70
20
10
85
35
37
19
12
15
55
38
54
2

BEVERAGE CONTAINER WITH VERTICALLY ADJUSTABLE BASE

BACKGROUND OF THE INVENTION

The present invention relates generally to beverage containers, and more particularly to such devices which have a vertically adjustable component thereby enabling the container to have at least two diameters for purposes of its being retained in a beverage container holder.

Beverage containers have enjoyed a proliferation in the marketplace. This is especially true of plastic beverage containers. Over the past couple of decades, sales of plastic squeeze bottles and newly designed plastic cups have soared. One reason why plastic cup sales have shown such strong growth is related to the increased frequency of finding beverage holders in automotive vehicles.

Convenience stores and fast-food establishments have marketed the accessibility and the desirability of enjoying a cup of coffee or a soft drink while driving. However, a significant problem all too well known exists. That problem results from having a beverage container too large in diameter to properly fit into the beverage holder. Attempts at coping with the problem include holding the container in the lap, balancing it on the floor or center console, having another passenger hold it, or just driving with one hand on the steering wheel. With some beverage holders a portion of the beverage container can be engaged, but unless the bottom of the container is resting on a flat surface, there is always the possibility of tipping due to the instability of the container so held.

Recognizing the problem, auto manufacturers and automotive accessory manufacturers have resorted to making the holders larger in diameter in an attempt to hold containers of more varied diameters. Meanwhile, some beverage container manufacturers have attempted to solve the problem by making containers with an inclined sidewall, i.e. wider at the top and narrower at the bottom, certain types of containers present additional problems.

For example, cups or mugs comprise a handle of some sort. The height of a cup is such that the presence of a handle often interferes with the bottom of the cup being able to rest on a flat surface, assuming that the cup or mug has a diameter small enough to fit within a cup or beverage holder. Another problem with cups or mugs is that they are often manufactured having a greater dimension than is associated with glasses. This is especially true with coffee cups or mugs designed to hold more than twelve ounces of liquid. Typically, the larger the volume, the larger the mug and hence the larger the diameter of the mug.

Some mugs have abandoned the hope that a beverage holder can be made to fit with existing mugs. These mugs have been designed having a significantly wider bottom, in an effort to be tip-proof. Such mugs normally are not used with a beverage holder, instead the mug is set on the center console or on some other flat surface. One problem attendant to such an environment is the likelihood of inertia acting on the mug in the event of a sudden stop or swerve, resulting in the contents of the mug being spilled. Another problem associated with not using a beverage holder, when an open beverage container is present, is that the container may be thrown about in the passenger compartment in the event of an accident.

It is thus apparent that the need exists for an improved beverage container for use with the beverage holders associated with vehicles, which beverage container can be securely retained in the beverage holder.

SUMMARY OF THE INVENTION

The problems associated with prior drinking containers are overcome in accordance with the present invention by the providing of a drinking container having a liquid containing portion and a slidably displaceable sleeve member. The liquid containing portion has a bottom surface with the slidably displaceable sleeve member being located adjacent the liquid containing portion. The sleeve member has a sidewall and a bottom surface. The sleeve member in a first position has its bottom surface spaced apart from the bottom surface of the liquid containing portion a first distance, while the sleeve member in a second position has its bottom surface spaced apart from the bottom surface of the liquid containing portion a second distance.

The drinking container preferably includes both a cap and a handle. The drinking container preferably has an upwardly projecting wall having at least one engaging member. Additionally, the sleeve member has a plurality of channels formed in its sidewall. The drinking container is formed having a first wall member and a second wall member, such that the sleeve member is retained between the first and second wall members.

There is also disclosed a drinking container having a liquid containing portion, a cap, a handle, and a slidably displaceable sleeve member located adjacent the liquid containing portion. The liquid containing portion has a bottom surface with the sleeve member having a sidewall and a bottom surface. The sidewall has a plurality of channels formed therein for engagement with at least one engaging member. Preferably at least one of the channels extends from an upwardly projecting wall portion of the drinking container. The sleeve member in a first position has its bottom surface spaced apart from the bottom surface of the liquid containing portion a first distance, while the sleeve member in a second position has its bottom surface spaced apart from the bottom surface of the liquid containing portion a second distance.

The liquid containing portion of the drinking container is configured to hold a maximum predetermined volume of liquid, with this volume not changing when the sleeve member is displaced from its first position to its second position. The plurality of channels of the drinking container include a first vertical channel, a second vertical channel, an intermediate horizontal channel, and a plurality of horizontal retention channels, each of the horizontal retention channels being connected to the second vertical channel. The intermediate horizontal channel is connected to the first and second vertical channels.

It is a primary object of the present invention to provide a drinking container which is adaptable for use in beverage holders of various diameters.

It is also an object of the present invention to provide a drinking container which is relatively inexpensive to fabricate, yet which solves the problem associated with drinking containers not fitting into a desired beverage holder.

Other objects and advantages of the invention will be apparent from the following description, the accompanying drawings and the appended claims.

DETAILED DESCRIPTION OF THE INVENTION

Figure 1:
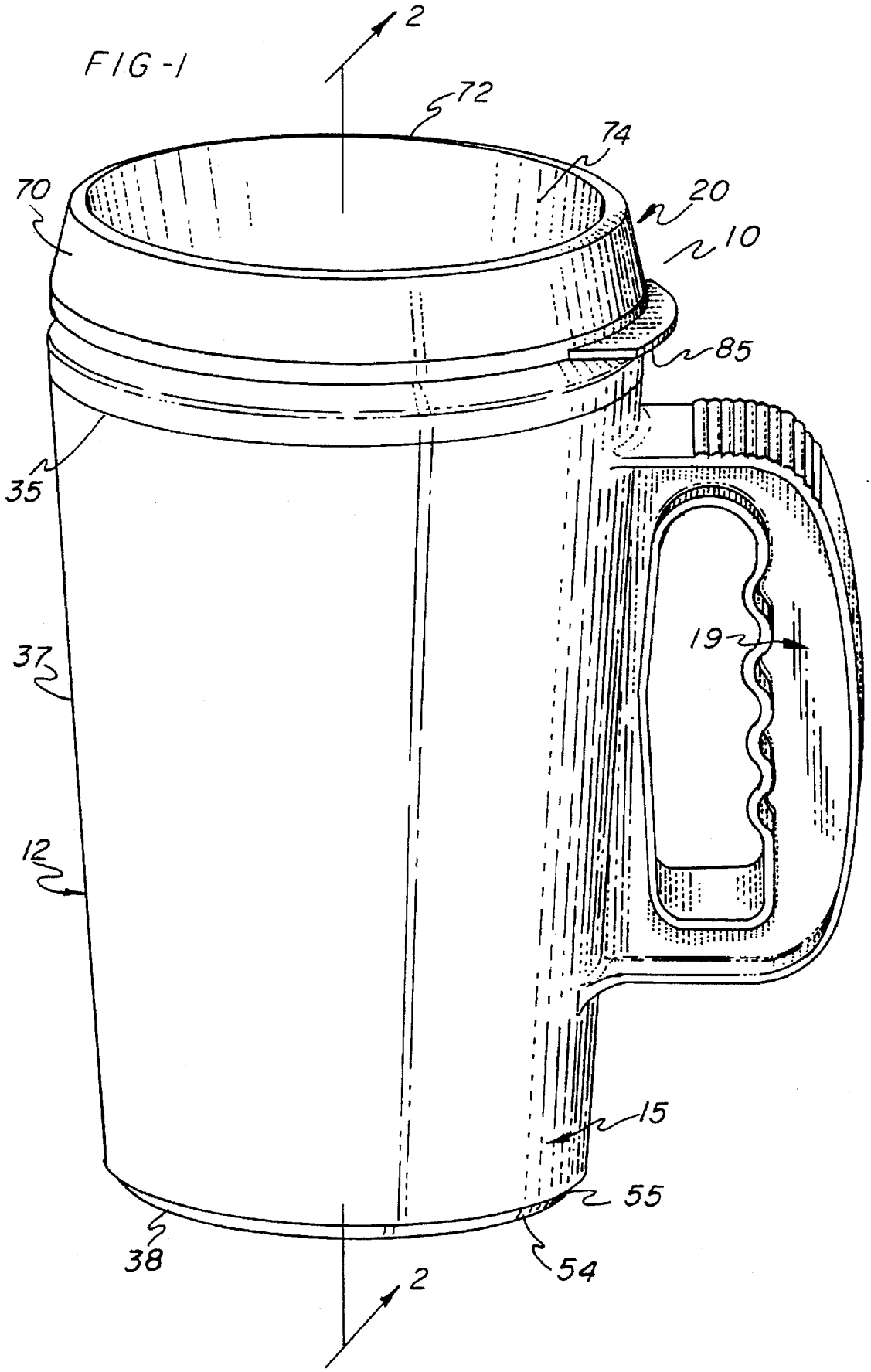
FIG. 1 is a perspective view of a beverage container embodying my new invention.

Having reference to the drawing figures, attention is first directed to FIG. 1 which discloses a beverage container embodying the invention with the beverage container being designated generally by the numeral 10. It will be noted that the beverage container is specifically shown as being a mug or cup, but other types of beverage containers could be made having the instant invention. The mug assembly 10 comprises a liquid containing portion 12 having a mug component or outer surface portion 15 and a liner or inner surface portion 17. Additionally the beverage container 10 preferably includes a handle 19 and a cap 20. However, the most unique aspect of this invention concerns the providing of an adaptor sleeve 25, which will be discussed at length below.

Figure 2:
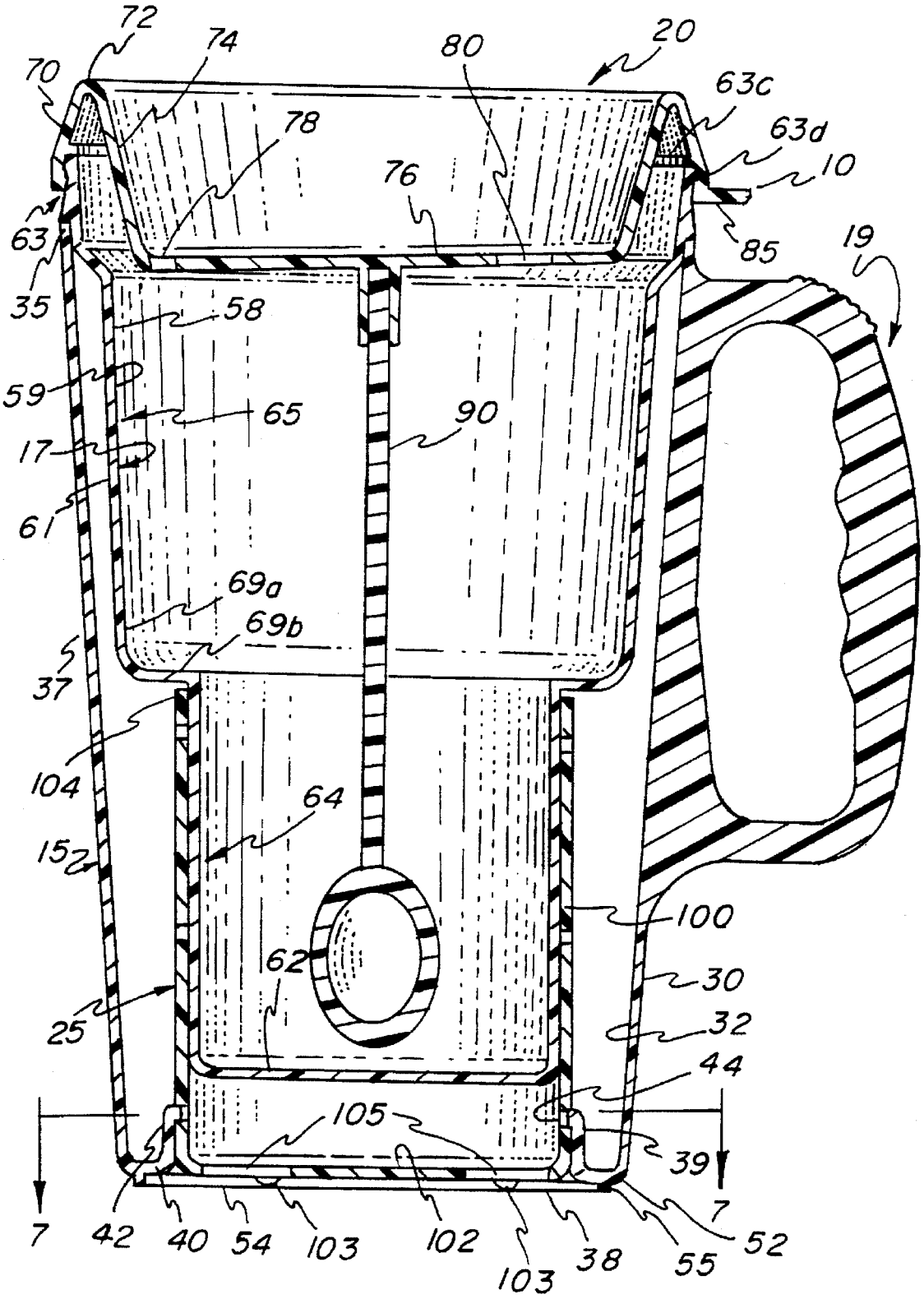
FIG. 2 is a vertical sectional view taken along line 2—2 of FIG. 1.

The mug component 15 has a mug first surface 30, which in effect is the exterior surface of the beverage container, and a mug second surface 32 as can best be appreciated from viewing FIG. 2. Additionally, the mug component 15 has a top edge 35, a mug sidewall 37, a mug base portion 38, and a mug connective portion 39. Preferably the diameter of the beverage container at the top edge is greater than the diameter of the beverage container at the bottom of the mug sidewall, such that the container's sidewall 37 inclines upwardly and outwardly from the bottom to the top.

As FIG. 2 discloses, at the bottom of the mug component, the mug connective portion 39 is comprised of a bottom surface 40, an upwardly projecting wall 42, and nubs 44. It will be appreciated that the mug connective portion 39, while part of the mug component, is also mechanically engaged to the adaptor sleeve 25. The bottom surface 40 of the mug connective portion 39 extends in a generally horizontally direction. The central-most portion of the bottom surface 40 connects to the upwardly projecting wall 42, with the nubs 44 (of which there are preferably two) projecting centrally of the upwardly projecting wall preferably at the wall's top.

Figure 8:
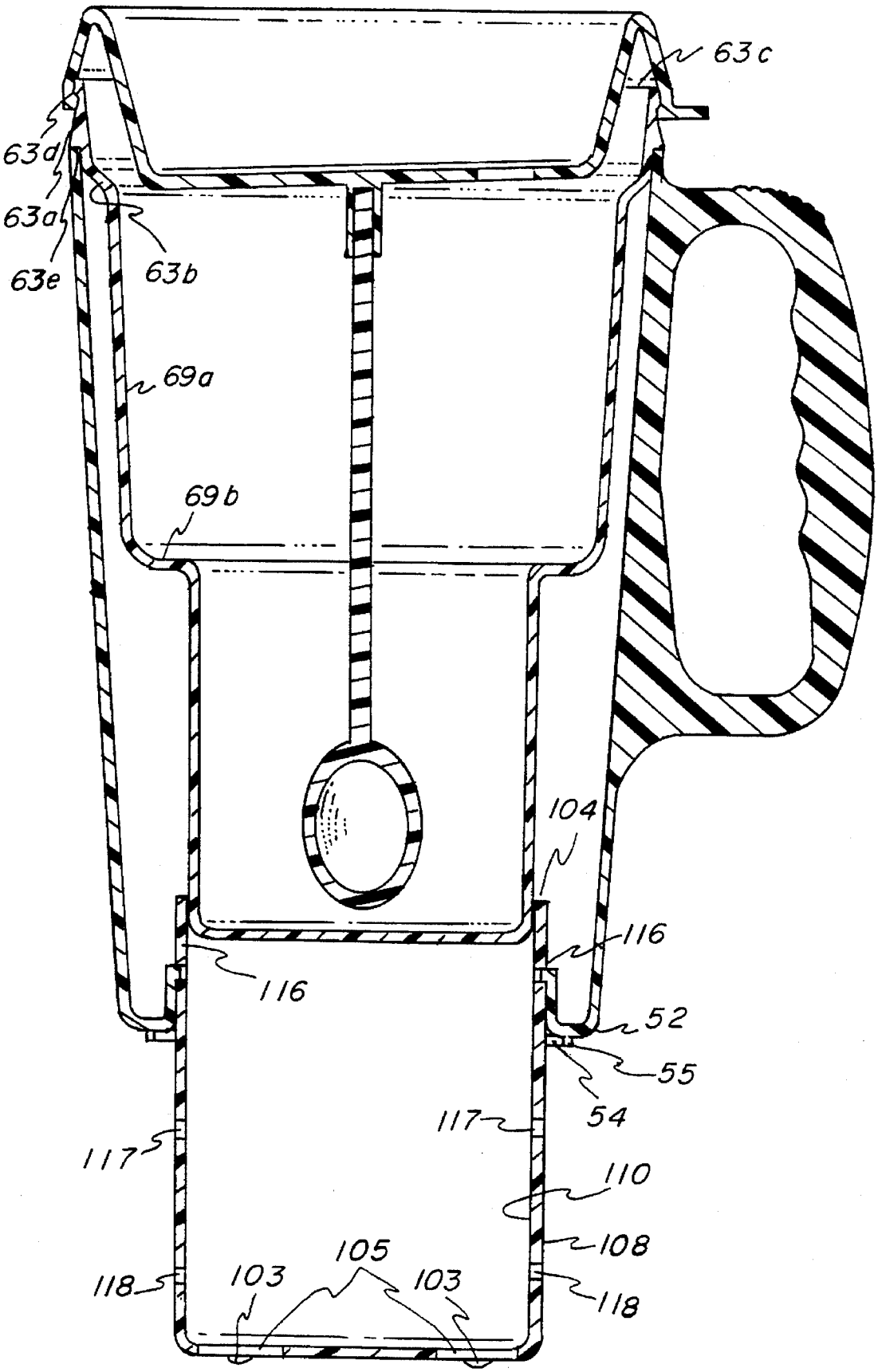
FIG. 8 is a vertical sectional view similar to FIG. 2, taken along the same line as FIG. 2, but showing the beverage container in another operative position.

The mug base portion 38 comprises a first edge portion 52, a second edge portion 54 and a base portion sidewall 55 as can best be seen from FIGS. 2 and 8. The first edge portion 52 extends centrally from the mug sidewall 37 in a generally horizontal direction. The base portion sidewall 55 extends downwardly from the first edge portion 52 and connects to the second edge portion 54 with the second edge portion being the effective bottom of the container when the container is set on a flat surface. Thus the diameter of the second edge portion is less than that of the diameter of the beverage container at the bottom of the mug sidewall.

Turning now to the liner component of the invention, the inner surface 17, as can best be seen in FIG. 2, has a liner sidewall 58, having a liner first surface 59 and a liner second surface 61. The liner first surface 59 is the surface portion of the beverage container which will be in contact with the beverage. Additionally, the liner component 17 comprises a liner bottom 62, an upper portion 63, a lower portion 64, and a liner connective portion 65. The liner bottom 62 is preferably horizontal. Extending upwardly and substantially vertically from the liner bottom 62 is lower portion 64.

Figure 3:
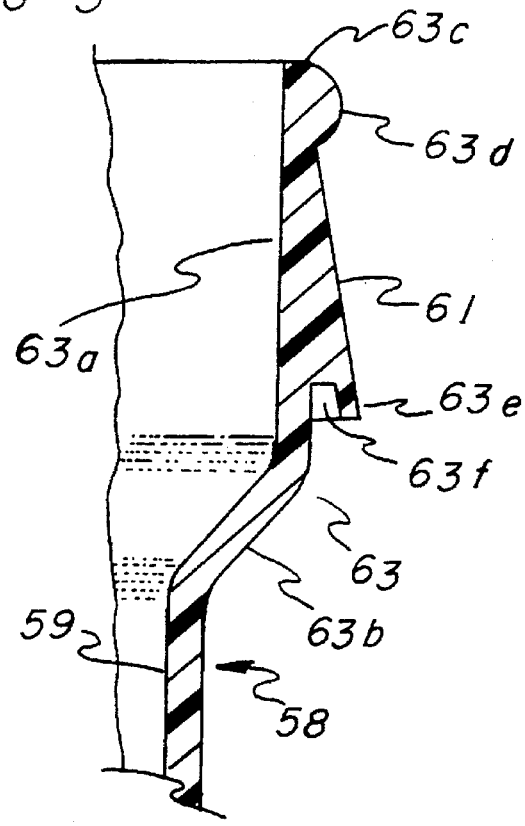
FIG. 3 is a vertical sectional view on a greatly enlarged scale of the upper portion of the liner sidewall shown in FIG. 2.
Figure 4:
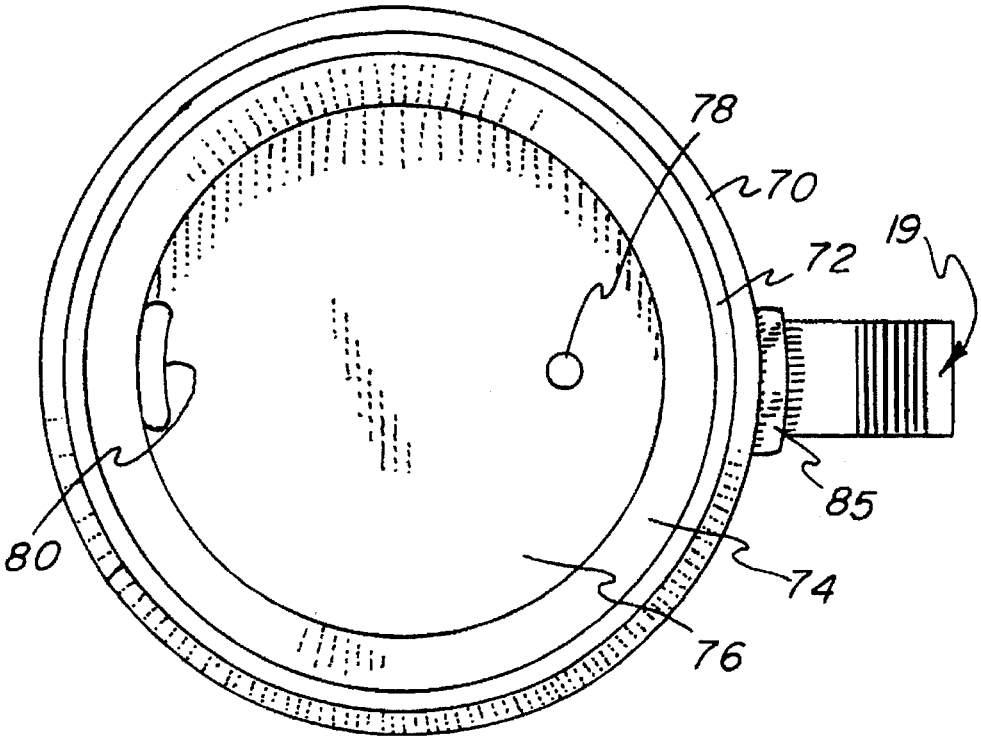
FIG. 4 is a top plan view.

As can best be appreciated from a comparison of FIGS. 2 and 3, the upper portion 63 includes several components. The upper portion's substantially vertical wall **63*a* is intermediate the upper portion's inclined surface 63*b* and top edge 63*c*. The inclined surface 63*b* extends upwardly and outwardly from the upper edge of liner connective portion 65. Meanwhile, just beneath the top edge 63*c* on the liner second surface 61 is lip 63*d*. Just above the juncture of the inclined surface 63*b* and the substantially vertical wall 63*a*, but as part of the liner second surface is peripheral rim 63*e*, with this peripheral rim 63*e* separated from the lower portion of the substantially vertical wall 63*a* by groove 63*f*. Groove 63*f* is just wide enough to have top edge 35 fit therein, thus providing a place to secure the mug component 15 to the liner component 17. Finally, the liner connective portion 65 has a substantially vertical portion 69*a* and a substantially horizontal portion 69*b*. The substantially vertical portion 69*a* is preferably directly adjacent the inclined surface 63*b*, while the substantially horizontal portion 69*b* has its one end connected to the substantially vertical portion 69*a* and the other end connected to lower portion 64**.

The preferred embodiment of the cap associated with this invention may be best appreciated from a comparison of FIGS. 1, 2, 4 and 8. The cap has an outer sidewall 70 which inclines upwardly and inwardly, a curved upper edge 72 at the apex of the outer sidewall 70, a sloped inner sidewall 74 which slopes downwardly and inwardly from the curved upper edge, and an inclined base 76 at the bottom of the sloped inner sidewall. This inclined base 76 includes a cap vent hole 78, which is preferably circular and which is located a distance centrally of the juncture of the sloped inner sidewall and the inclined base. The inclined base also includes a drink aperture 80 which is preferably a curved opening or slot immediately adjacent the juncture of the sloped inner sidewall and the inclined base. As can best be appreciated from a comparison of FIGS. 2 and 4, the cap vent hole 78 and the drink aperture 80 are preferably on the same axis, with the cap vent hole being offset from the actual center of the inclined base.

The cap 20 also is shown having a cap flange member 85 to assist in the removal of the cap 20 from the beverage container 10. This cap flange member 85 is at the lower edge of outer 70, and preferably is on the same axis as the cap vent hole 78 and drink aperture 80. There is also a stirrer 90 shown in the preferred embodiment of the invention, with this stirrer being attached to, and downwardly depending from, the cap 20. The stirrer extends down into the area of the liner component 17 associated with the lower portion 64.

Turning now to a comparison of FIGS. 2, 5, 6, 7, and 8 discloses the structure of adaptor sleeve 25. Adaptor sleeve 25 has an adaptor sidewall 100 and an adaptor bottom 102 with downwardly disposed nubs 103. The vertically disposed adaptor sidewall has a top edge 104. The horizontal adaptor bottom 102 has a plurality of vent holes 105. The adaptor sidewall also has an outer surface 108 and an inner surface 110. The inner surface 110 is directly adjacent the liner second surface 61 which is associated with the lower portion 64 of the liner component. Meanwhile the outer surface 108 is in contact with nubs 44 of the mug connective portion 39.

Extending downward from the top edge 104 of the adaptor sleeve 25 are a pair of equidistantly spaced first vertical channels 112. A second vertical channel 113 extends parallel to the first vertical channel 112, but reaches neither the top edge 104 nor the bottom of the adaptor sleeve. An intermediate horizontal channel 114 extends from the bottom of the first vertical channel to a point slightly below the top of the second vertical channel.

In the preferred embodiment of the invention, two sets of three channels extend horizontally away from the second vertical channel on the opposite side of the second vertical channel from the intermediate horizontal channel 114. These three channels are a first horizontal retention channel 116, a second horizontal retention channel 117, and a third horizontal retention channel 118, with each of the three channels having respective ends 120. Preferably the first horizontal retention channel is located directly adjacent the top of the second vertical channel, and the third horizontal retention channel is located directly adjacent the bottom of the second vertical channel. In the preferred embodiment of the invention the second horizontal retention channel is positioned between the first and third horizontal retention channels, but slightly closer to the first horizontal retention channel.

Adjacent the ends 120 of each of the horizontal retention channels 116, 117, and 118 are locking nubs 122, 123, and 124 respectively. Each of the locking nubs are spaced far enough from the ends 120 to permit each pair of nubs 44 to have one of each pair located between the locking nub and the end 120 with the other one of each pair located between the locking nub and the second vertical channel 113. This relationship between the hubs and locking nubs can be appreciated from FIG. 7.

Figure 6:
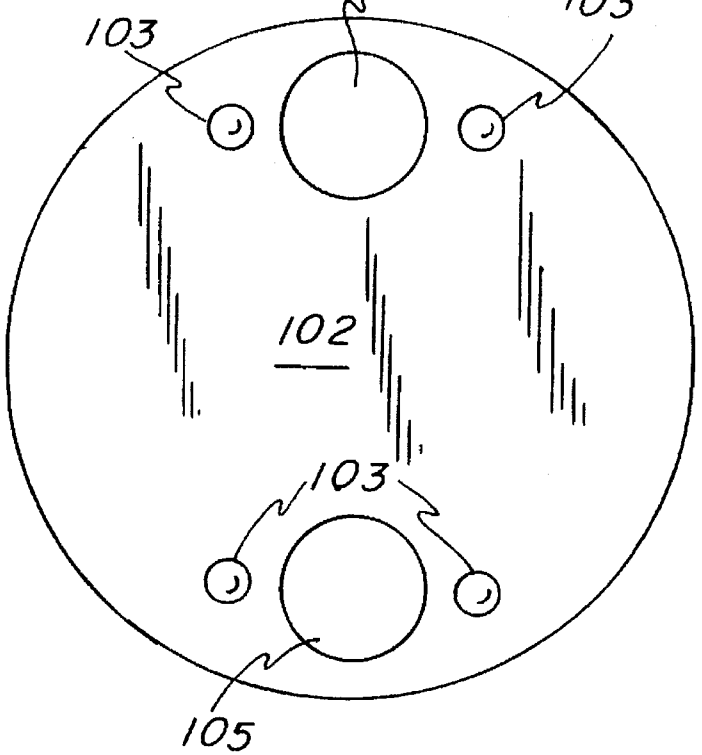
FIG. 6 is a bottom plan view.
Figure 5:
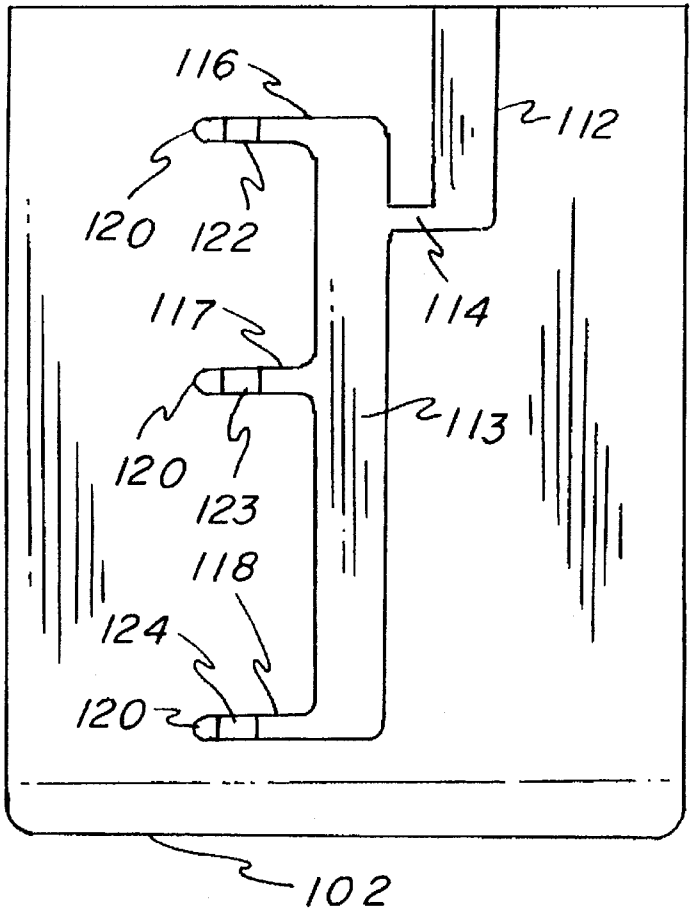
FIG. 5 is a perspective view of the adaptor sleeve associated with this invention.
Figure 7:
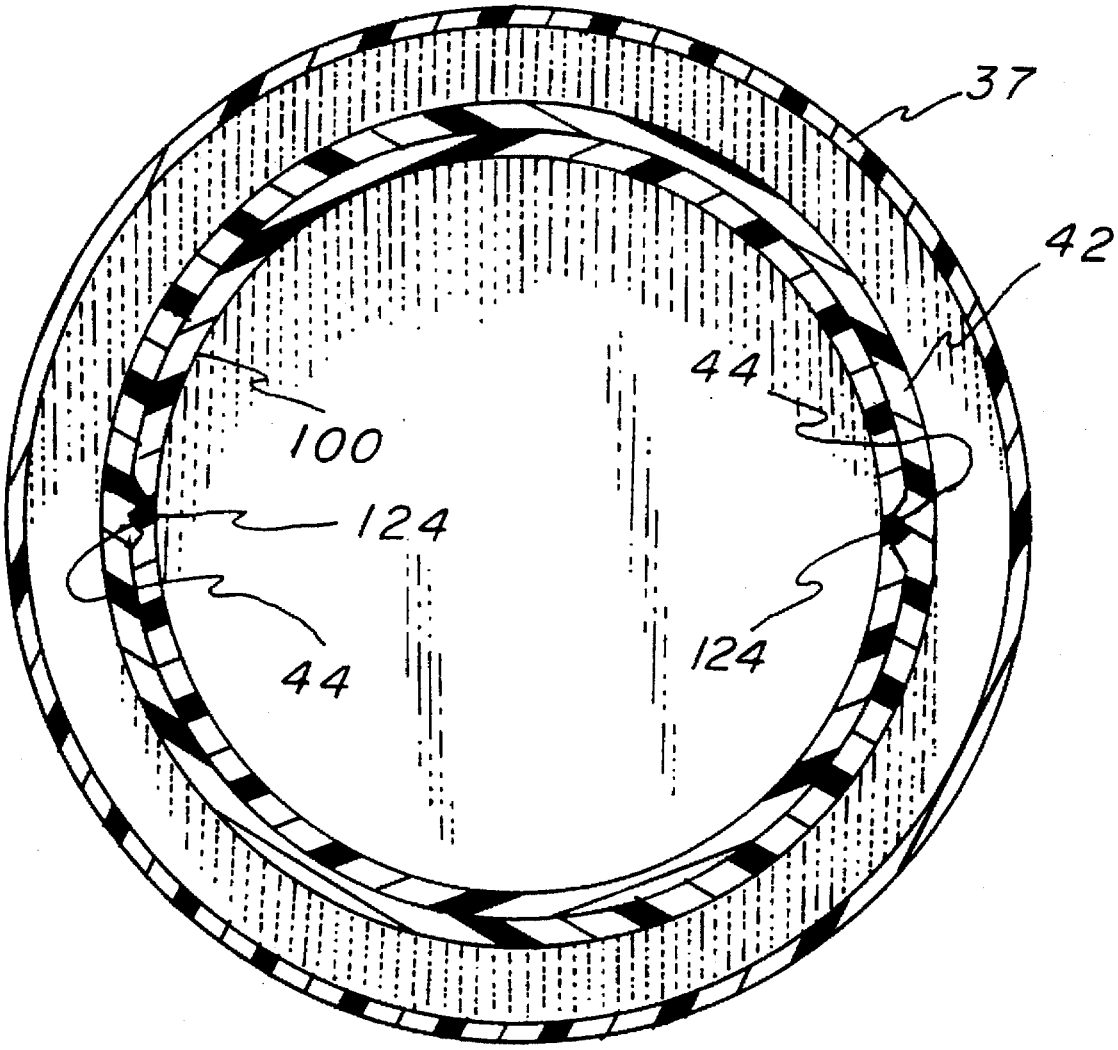
FIG. 7 is a horizontal sectional view taken along line 7—7 of FIG. 2.

Comparing FIGS. 5 and 6 provide a better understanding of the preferred embodiment of the bottom of the adaptor sleeve 25. The horizontal adaptor bottom 102 features two relatively large vent holes 105. The size of the holes permits the user to insert a finger into each hole so as to effect the twisting necessary to operate the adaptor.

Figure 10:
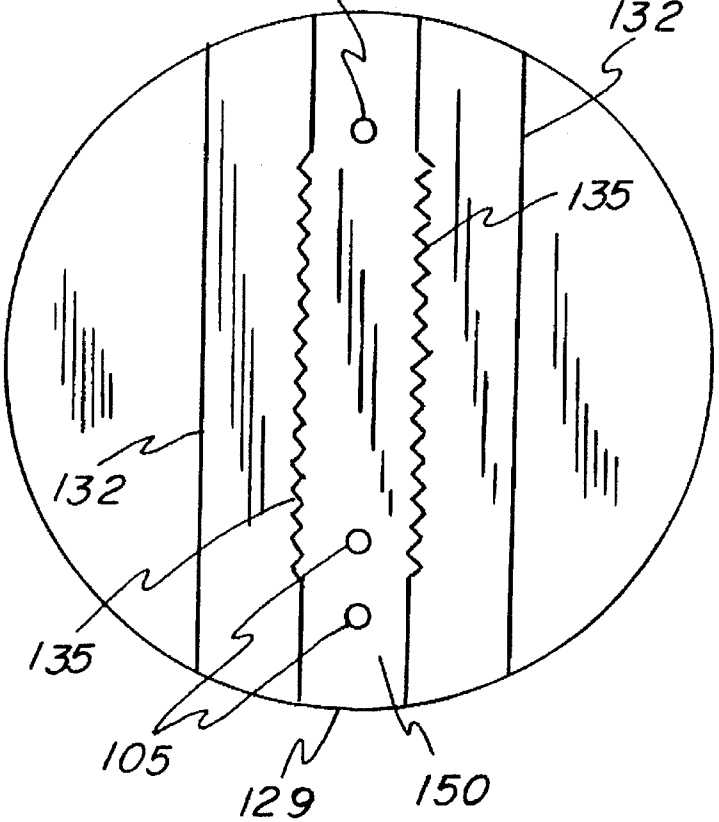
FIG. 10 is a bottom plan view of the modified adaptor sleeve of FIG. 9.
Figure 9:
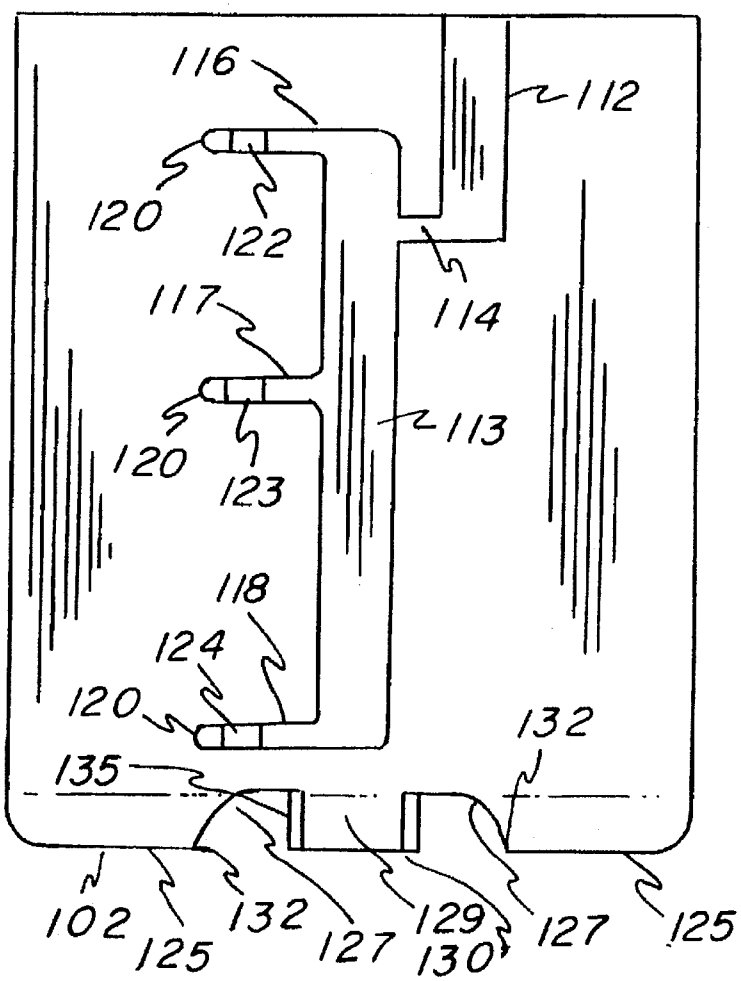
FIG. 9 is a perspective view of a modified adaptor sleeve.

FIGS. 9 and 10 disclose a modified embodiment of an adaptor sleeve. The horizontal adaptor bottom 102 of the modified embodiment of the sleeve includes two horizontal planar portions 125, two upwardly extending arcuate portions 127, and a center portion 129. The center portion 129 has a center portion bottom surface 130. The arcuate portion 127 extends from a chordate line 132 at the central-most portion of each of the planar portions 125. Extending upwardly from each side of the center portion 129 to each of the arcuate portions 127 is a center portion sidewall 134, a portion of which is a serated sidewall 135. In this embodiment, the user grasps the serated sidewall and then twists the adaptor sleeve to effect operation.

The actual fabrication of the beverage container of this invention preferably involves the molding of the outer surface 15 and handle 19, if there is one, as a unitary item. The inner surface 17 is then inserted into the mug component 15 and secured thereto. Also the adaptor sleeve 25 is inserted into the bottom of the mug component and twisted. The engagement of the nubs 44, first in the first vertical channel 112, and thereafter in the intermediate horizontal channel 114 and second vertical channel 113 respectively, followed by their initial engagement in third horizontal retention channel 118 position the adaptor sleeve in the position reflected in both FIG. 1 and 2. The cap 20, if any, may then be positioned atop the beverage container.

The preferred dimensions associated with this invention include a distance from the container top edge to the container bottom edge of approximately 5.9", and an inner diameter across the top of the open container of 3.8". The liner itself is of a height of 5.7". The distance across the liner connective portion is about 3.38", while the distance across the lower portion of the liner is about 2.28". The heighth of the liner connective portion is about 2.54", and the heighth of the lower portion of the liner is about 2.43".

The heighth of the adaptor sleeve is about 3", and its inner diameter is about 2.29" and its outer diameter is about 2.46". All four vertical channels are 0.25" wide, with all the horizontal channels being about 0.085" wide. The first horizontal retention channel is spaced a distance below the top edge of the adaptor sleeve of about 0.52". The second horizontal retention channel is spaced below the top edge of the adaptor sleeve a distance of about 1.4". The third horizontal retention channel is spaced below the top edge of the adaptor sleeve a distance of about 2.65".

The diameters associated with the outer sidewall of the cap are an inner diameter of about 3.98" and an outer diameter of about 4.17". The outer sidewall is inclined upwardly and inwardly 15° from vertical, while the sloped inner sidewall is inclined upwardly and outwardly 15° from vertical. The vertical distance from the upper edge to the outer sidewall bottom edge is about 0.67".

The diameter across the cap at its upper edge is about 3.61". The inclined base has a preferred inclination of 2° from horizontal, with the vertical distance from the uppermost edge of the inclined base to the upper edge of the cap being about 1". The cap flange member is about 0.75" wide and extends outwardly from the outer sidewall about 0.25". The cap vent hole has a diameter of about 0.185", and the drink aperture is about 0.17" wide and extends along the inclined base at its juncture with the sloped inner sidewall through an arc of about 30°.

When fully assembled, the beverage container of this invention is 6.88" tall. In its most extended position, the bottom of the adaptor sleeve extends about 2.08" below second edge portion 54.

In the preferred embodiment of the invention, the entire beverage container is fabricated from plastic, preferably polypropylene. The choice of manufacturing material permits the product to be fabricated using existing technology as well as from a relatively cheap starting material. Preferably the choice of plastic is one which will result in a fairly rigid container.

In actual use, a twisting of the adaptor sleeve 25 permits the hubs 44 to travel into the second vertical channel 113. Once the nubs are there, the adaptor drops down below the mug base portion. It then may be twisted again such that the hubs are slidably displaceable through either the first or second horizontal retention channel, depending on the preference of the user. Thus, the overall height of the beverage container may be varied, although the volume of the liquid containing portion remains the same. In its initial position, the sleeve member 25 is in a first position with its bottom surface spaced apart from the bottom surface of the liquid containing portion a first distance, while in its second position the sleeve member has its bottom surface spaced apart from the bottom surface of the liquid containing portion a second distance.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A drinking container comprising a liquid containing portion having a bottom surface, a first wall member;

a second wall member, and a slidably displaceable sleeve member located adjacent said liquid containing portion, said sleeve member having a sidewall and a bottom surface, said sleeve member in a first position having its bottom surface spaced apart from said bottom surface of said liquid containing portion a first distance, said sleeve member in a second position having its bottom surface spaced apart from said bottom surface of said liquid containing portion a second distance, said sleeve member retained between said first and second wall members.

2. The drinking container according to claim 1 which includes a cap.

3. The drinking container according to claim 1 which includes a handle.

4. The drinking container according to claim 1 wherein said drinking container comprises an upwardly projecting wall having at least one engaging member, and said sleeve member has a plurality of channels formed in its sidewall.

5. The drinking container according to claim 1 wherein said liquid containing portion is configured to hold a maximum predetermined volume of liquid, said volume not changing when said sleeve member is displaced from its first position to its second position.

6. The drinking container according to claim 5 which includes a cap.

7. The drinking container according to claim 5 which includes a handle.

8. The drinking container according to claim 5 wherein said drinking container comprises an upwardly projecting wall having at least one engaging member, and said sleeve member has a plurality of channels formed in its sidewall.

9. The drinking container according to claim 8 wherein said plurality of channels comprise a first vertical channel, a second vertical channel, an intermediate horizontal channel, said intermediate horizontal channel connecting said first and second vertical channels, and a plurality of horizontal retention channels, each of said horizontal retention channels connected to said second vertical channel.

10. A drinking container comprising a liquid containing portion having a bottom surface, an upwardly projecting wall having at least one engaging member and a slidably displaceable sleeve member located adjacent said liquid containing portion, said sleeve member having a sidewall and a bottom surface, said sleeve member in a first position having its bottom surface spaced part from said bottom surface of said liquid containing portion a first distance, said sleeve member in a second position having its bottom surface spaced apart from said bottom surface of said liquid containing portion a second distance, said sleeve member having a plurality of channels formed in its sidewall, said plurality of channels comprise a first vertical channel, a second vertical channel, an intermediate horizontal channel, said intermediate horizontal channel connecting said first and second vertical channels, and a plurality of horizontal retention channels, each of said horizontal retention channels connected to said second vertical channel.

11. The drinking container according to claim 10 which includes a cap.

12. The drinking container according to claim 10 which includes a handle.

13. The drinking container according to claim 10 wherein said liquid containing portion is configured to hold a maximum predetermined volume of liquid, said volume not changing when said sleeve member is displaced from its first position to its second position.

14. A drinking container comprising a liquid containing portion having a bottom surface, a cap, a handle, and a slidably displaceable sleeve member located adjacent said liquid containing portion, said sleeve member having a sidewall and a bottom surface, said sidewall having a plurality of channels formed therein for engagement with at least one engaging member, at least one of said channels extending from an upwardly projecting wall portion of said drinking container, said sleeve member in a first position having its bottom surface spaced apart from said bottom surface of said liquid containing portion a first distance, said sleeve member in a second position having its bottom surface spaced apart from said bottom surface of said liquid containing portion a second distance, said plurality of channels comprising a first vertical channel, a second vertical channel, an intermediate horizontal channel, said intermediate horizontal channel connecting said first and second vertical channels, and a plurality of horizontal retention channels, each of said horizontal retention channels connected to said second vertical channel.

15. The drinking container according to claim 14 wherein said liquid containing portion is configured to hold a maximum predetermined volume of liquid, said volume not changing when said sleeve member is displaced from its first position to its second position.

* * * * *